US007003449B1

(12) United States Patent
Absar et al.

(10) Patent No.: US 7,003,449 B1
(45) Date of Patent: Feb. 21, 2006

(54) METHOD OF ENCODING AN AUDIO SIGNAL USING A QUALITY VALUE FOR BIT ALLOCATION

(75) Inventors: Mohammed Javed Absar, Singapore (SG); Sapna George, Singapore (SG)

(73) Assignee: STMicroelectronics Asia Pacific PTE Ltd., Singapore (SG)

( * ) Notice: Subject to any disclaimer, the term of this patent is extended or adjusted under 35 U.S.C. 154(b) by 0 days.

(21) Appl. No.: 10/129,045

(22) PCT Filed: Oct. 30, 1999

(86) PCT No.: PCT/SG99/00112

§ 371 (c)(1),
(2), (4) Date: Jan. 10, 2003

(87) PCT Pub. No.: WO01/33555

PCT Pub. Date: May 10, 2001

(51) Int. Cl.
*G10L 19/02* (2006.01)

(52) U.S. Cl. ..... 704/200.1

(58) Field of Classification Search ..... 704/200–201, 704/229, 230, 500
See application file for complete search history.

(56) References Cited

U.S. PATENT DOCUMENTS

| | | | | |
|---|---|---|---|---|
| 5,235,671 | A * | 8/1993 | Mazor | 704/200 |
| 5,301,255 | A * | 4/1994 | Nagai et al. | 704/230 |
| 5,475,789 | A * | 12/1995 | Nishiguchi | 704/200 |
| 5,623,577 | A | 4/1997 | Fielder | 704/229 |
| 5,649,054 | A * | 7/1997 | Oomen et al. | 704/229 |
| 5,706,392 | A * | 1/1998 | Goldberg et al. | 704/200.1 |
| 5,832,427 | A * | 11/1998 | Shibuya | 704/230 |
| 6,226,616 | B1 * | 5/2001 | You et al. | 704/500 |
| 6,370,502 | B1 * | 4/2002 | Wu et al. | 704/230 |
| 6,411,925 | B1 * | 6/2002 | Keiller | 704/200 |
| 2002/0111801 | A1 * | 8/2002 | Wu et al. | 704/230 |

FOREIGN PATENT DOCUMENTS

EP 0 703 677 A2 3/1996

OTHER PUBLICATIONS

Voran, S., "Perception-Based Bit-Allocation Algorithms for Audio Coding," *Proceedings of IEEE ASSP Workshop on Applications of Signal Processing to Audio and Acoustics*, New Paltz, NY, Oct. 19-22, 1997, 4 pages, XP002140986.
Tang, B. et al., "A Perpetually Based Embedded Subband Speech Coder," *IEEE Trans. on Speech and Audio Processing*, 5(2):131-140, Mar. 1997.
Brandenburg, K., "Overview of MPEG, Audio, Current and Future Standards for Low-Bit-Rate Audio coding," *Journ. of the Audio Engineering Soc.*, 45(1/02):4-21, Jan. 1997.

* cited by examiner

*Primary Examiner*—David D. Knepper
(74) *Attorney, Agent, or Firm*—Lisa K. Jorgenson; Timothy L. Boller; Seed IP Law Group PLLC

(57) ABSTRACT

A method for encoding an audio signal, including providing a masking function, representative of psychoacoustic masking; setting a quality value for data of the encoded signal, adjusting the masking function dependent upon the quality value; and allocating bits for quantization of the encoded signal based on the incremental masking function.

20 Claims, 6 Drawing Sheets

FIGURE 3
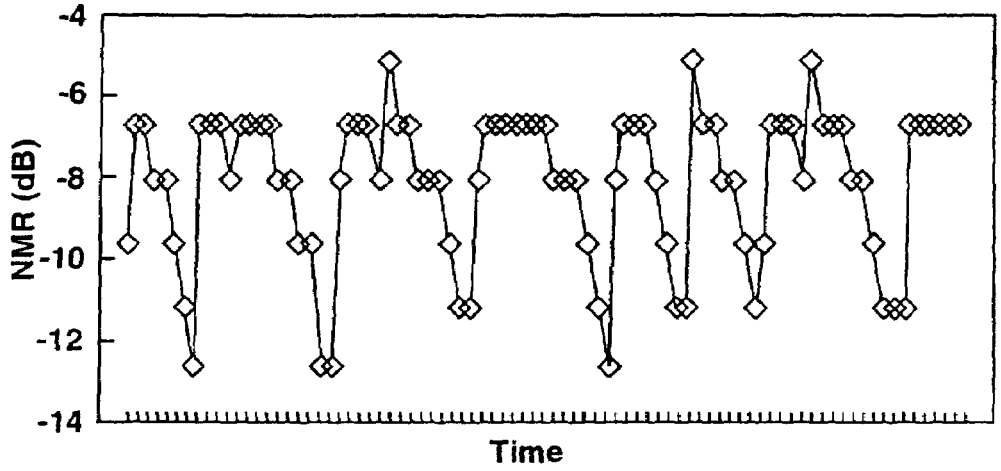
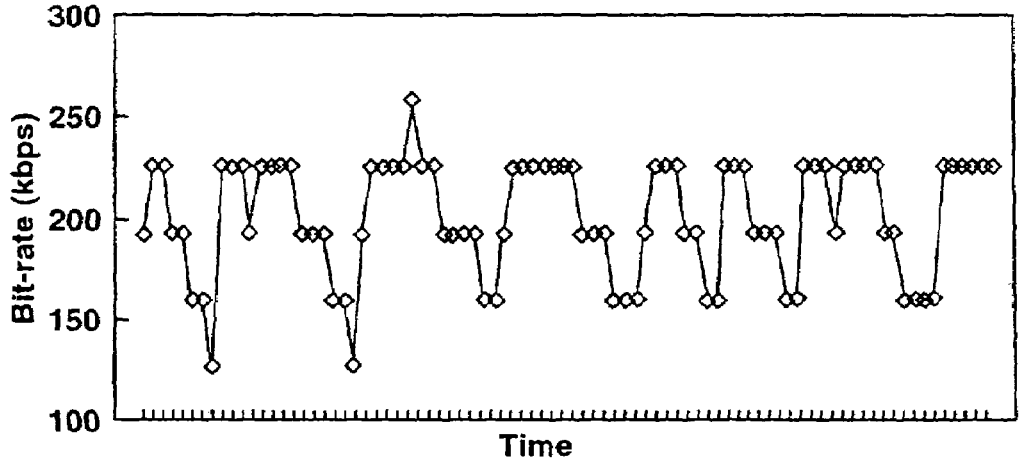
FIGURE 4

METHOD OF ENCODING AN AUDIO SIGNAL USING A QUALITY VALUE FOR BIT ALLOCATION

FIELD OF THE INVENTION

The present invention relates to a method of encoding an audio signal using a quality value for bit allocation, particularly but not exclusively, for quantisation of an audio signal in an AC-3 encoder.

BACKGROUND OF THE INVENTION

AC-3 is a transform-based audio coding algorithm designed to provide data-rate reduction for wide-band signals while maintaining the high quality of the original content. In the consumer electronics industry AC-3 soundtrack can be found on the latest generation of laser disc, can be found as the standard audio track on Digital Versatile Discs (DVD), is the standard audio format for High Definition Television (HDTV), and is being used for digital cable and satellite transmissions.

AC-3 allows transmission bitrate to change with each frame (approximately 32 ms.), since the bitrate information is part of the side-information bits in the AC-3 frame. In most cases, a constant bitrate is desired since it reduces software and hardware complexities thereby providing an encoding scheme suited for consumer products such as DVD and HDTV.

However, with new applications such as audio streaming over Internet and audio broadcast over mobile equipment, the constant bitrate encoder is not always the best answer.

Constant bitrate encoding schemes may have the disadvantage of providing variable quality. When a signal being compressed is psychoacoustically-simple (single tone), the encoder does a very efficient job and is able to compress it to a size much below the specified frame length (equivalently, the specified bitrate) and still maintain the coding error below the audible range. To produce a frame of the pre-defined size, it then has to perform some sort of zero padding. This may happen at times when the network is bitrate hungry. On the other hand, if this compressed data is to be archived on to a media, much space might be wasted in storing such zeros.

When the audio signal is complex (e.g. castanet), the pre-defined bitrate may not prove sufficient for the encoder. Nevertheless, to respect the constant bitrate agreement, the encoder would degrade the coding quality to the extent of producing noisy or annoying sounds.

Constant bit-rates may be the most desirable property in some applications, but for applications with more flexibility in terms of bitrate, a scheme is required to exploit this freedom for a more intelligent utilisation of bandwidth.

SUMMARY OF THE INVENTION

In accordance with the invention, there is provided a method for encoding an audio signal, including:

- providing a masking function, representative of psychoacoustic masking;
- setting a quality value for data of the encoded signal,
- adjusting the masking function dependent upon the quality value; and
- allocating bits for quantisation of the encoded signal based on the incremented masking function.

Preferably, the quality value represents an average weighted noise-to-mask ratio (AWNMR).

Preferably, the quality value is equated to a variable θ, such that $$AWNMR(\text{db}) \geq \frac{20}{N}\sum_{k=1}^{N}\left[\log_{10}\left(\frac{2^{2(\bar{S}_v/128-24)}}{3-2^{2(\bar{S}_v/128-24)}}\right)+\frac{w_k}{20}\right]=$$

$$\frac{20}{N}\sum_{k=1}^{N}\left[\log_{10}\left(\frac{2^{(\bar{S}_v-S_v)/64}}{3}\right)+\frac{w_k}{20}\right]=\theta(snroffst)$$

Preferably, transform coefficients are derived from the audio signal for encoding and are mapped to a power spectrum density function (PSD) and the bit allocation is determined by differencing the PSD and the adjusted masking function.

Preferably, encoding the audio signal includes dividing the signal into a plurality of frames, for carrying quantisation and other signal data, and increasing or decreasing one or decreasing or more frame lengths until the associated frame accommodates the bits allocated for quantisation.

BRIEF DESCRIPTION OF THE DRAWINGS

The invention is described, by way of non-limiting example only, with reference to the accompanying drawings, in which:

FIG. 3 is a plot of Noise-Mask-Ratio (dB) for castanets;

FIG. 4 illustrates bit-rate requirements for castanets, with a Noise-Mask-Ratio fixed at −7 dB.

DETAILED DESCRIPTION OF A PREFERRED EMBODIMENT OF THE INVENTION

The following description is divided into sections A to D. In Section A the different blocks of an AC-3 Encoder are briefly described. Following this, the psychoacoustic model, specially in relation to AC-3, is described in Section B, with a view to deriving the equations for the quality value in Sec. C. Using the derivation in Sec. C, an algorithm is derived in Sec. D for constant quality variable rate coding.

A. AC-3 System: Block Level Description

Figure 1:
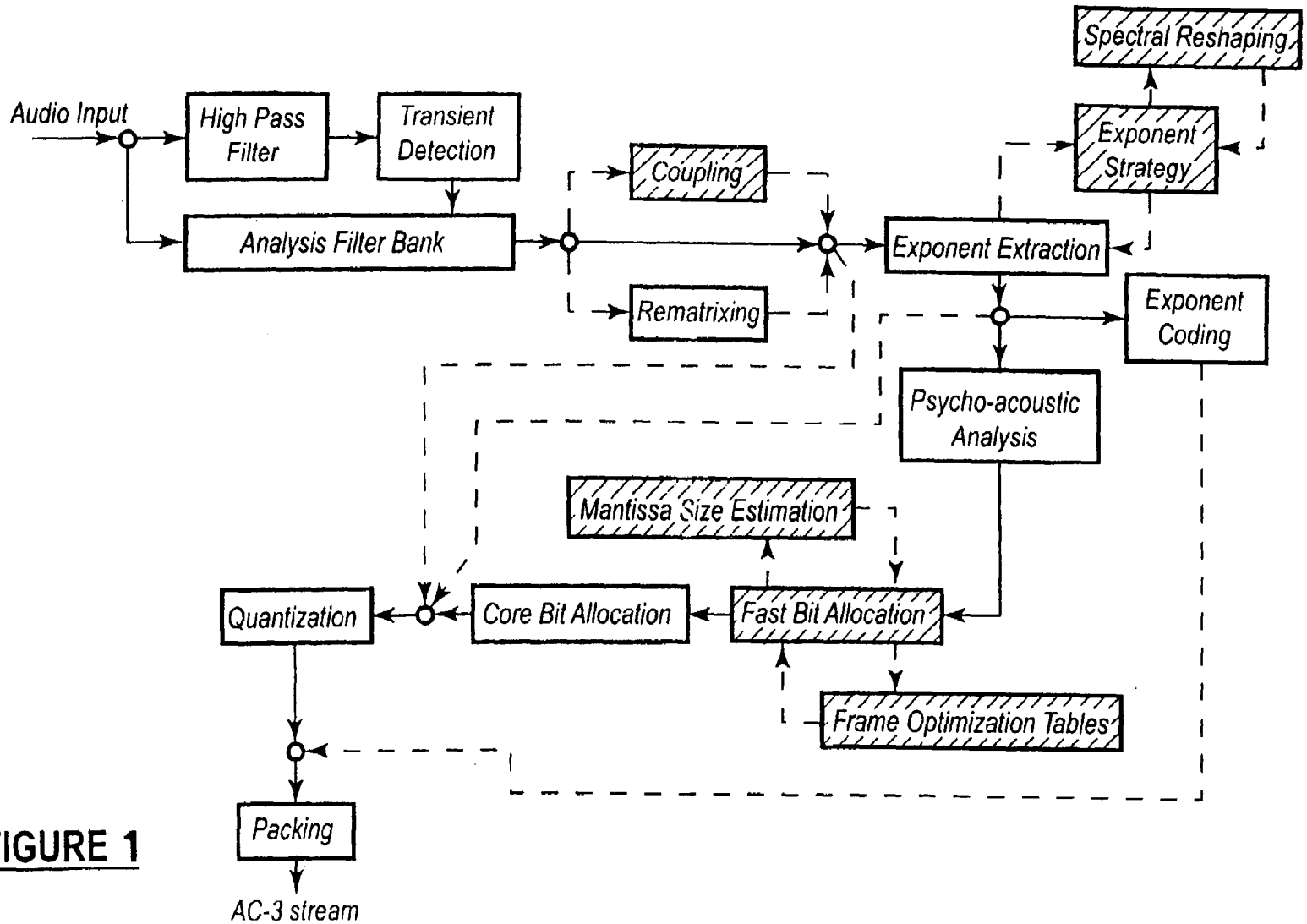
FIG. 1 is a system diagram of an AC-3 encoder.

Like the AC-2 single channel coding technology from which it derives, AC-3 is fundamentally an adaptive transform-based coder using a frequency-linear, critically sampled filter-bank based on the Princen Bradley Time Domain Aliasing Cancellation (TDAC) technique J. P. Princen and A. B. Bradley, *"Analysis/Synthesis Filter Bank Design Based on Time Domain Aliasing Cancellation", IEEE Trans. Acoust., Speech, Signal Processing*, vol. ASSP-34, no. 5, pp. 1153–1161, October 1986. The AC-3 system diagram is shown in FIG. 1.

A.1 Input Format

AC-3 is a frame based encoder. Each frame contains information equivalent to 256×6 PCM (pulse code modulated) samples per audio channel. For coding convenience, the frame is divided into six audio blocks, each block therefore containing information of 256 samples per channel.

A.2 Transient Detection

Transients are detected in the full-bandwidth channels in order to decide when to switch to short length audio blocks for restricting quantization noise associated with the transient within a small temporal region about the transient. High-pass filtered versions of the signals are examined for an increase in energy from one sub-block time segment to the next. Sub-blocks are examined at different time scales. If a transient is detected in the second half of an audio block in a channel, that channel switches to a short block. In presence of transient the bit 'blksw' for the channel in the encoded bit stream in the particular audio block is set.

A.3 Frequency Transformation

Each channel's time domain input signal is windowed and filtered with a TDAC-based analysis filter bank to generate frequency domain coefficients. If transient was detected for the block, two short transforms of length 256 each are taken, which increases the temporal resolution of the signal. If transient is not detected, a single long transform of length 512 is taken, thereby providing a high spectral resolution.

The output frequency coefficient $X_k$ is defined as:

$$X_k = \sum_{n=0}^{N-1} x[n] * \cos(2\pi * (2n+1) * (2k+1)/4N + \pi * (2k+1)/4)$$

$$k = 0 \ldots (N/2-1)$$

where x[n] is the windowed input sequence for a channel and N is the transform length.

A.4 Coupling

High compression can be achieved in AC-3 by use of a technique known as coupling. Coupling takes advantage of the way the human ear determines directionality for very high frequency signals. At high audio frequency (approx. above 4 KHz.), the ear is physically unable to detect individual cycles of an audio waveform and instead responds to the envelope of the waveform. Consequently, the encoder combines the high frequency coefficients of the individual channels to form a common coupling channel. The original channels combined to form the coupling channel are called the coupled channel.

A.5 Rematrixing

An additional process, rematrixing, is invoked in the special case that the encoder is processing two channels only. The sum and difference of the two signals from each channel are calculated on a band by band basis, and if, in a given band, the level disparity between the derived (matrixed) signal pair is greater than the corresponding level of the original signal, the matrix pair is chosen instead. More bits are provided in the bit stream to indicate this condition, in response to which the decoder performs a complementary unmatrixing operation to restore the original signals. The rematrix bits are omitted if the coded channels are more than two.

The benefit of this technique is that it avoids directional unmasking if the decoded signals are subsequently processed by a matrix surround processor, such as Dolby Prologic decoder.

In AC-3, rematrixing is performed independently in separate frequency bands. There are four band with boundary locations dependent on the coupling information. The boundary location are by coefficient bin number, and the corresponding rematrixing band frequency bou ndaries change with sampling frequency.

A.6 Conversion to Floating Point

The coefficient values, which may have undergone rematrix and coupling process, are converted to a specific floating point representation, resulting in separate arrays of exponents and mantissas. This floating point arrangement is maintained through out the remainder of the coding process, until just prior to the decoder's inverse transform, and provides 144 dB dynamic range, as well as allows AC-3 to be implemented on either fixed or floating point hardware.

Coded audio information consists essentially of separate representation of the exponent and mantissas arrays. The remaining coding process focuses individually on reducing the exponent and mantissa data rate.

The exponents are coded using one of the exponent coding strategies. Each mantissa is truncated to a fixed number of binary places. The number of bits to be used for coding each mantissa is to be obtained from a bit allocation algorithm which is based on the masking property of the human auditory system.

A.7 Exponent Coding Strategy

Exponent values in AC-3 are allowed to range from 0 to −24. The exponent acts as a scale factor for each mantissa. Exponents for coefficients which have more than 24 leading zeros are fixed at −24 and the corresponding mantissas are allowed to have leading zeros.

AC-3 bit stream contains exponents for independent, coupled and the coupling channels. Exponent information may be shared across blocks within a frame, so blocks 1 through 5 may reuse exponents from previous blocks.

AC-3 exponent transmission employs differential coding technique, in which the exponents for a channel are differentially coded across frequency. The first exponent is always sent as an absolute value. The value indicates the number of leading zeros of the first transform coefficient. Successive exponents are sent as differential values which must be added to the prior exponent value to form the next actual exponent value.

The differential encoded exponents are next combined into groups. The grouping is done by one of the three methods: D15, D25 and D45. These together with 'reuse' are referred to as exponent strategies. The number of exponents in each group depends only on the exponent strategy. In the D15 mode, each group is formed from three exponents. In D45 four exponents are represented by one differential value. Next, three consecutive such representative differential values are grouped together to form one group. Each group always comprises of 7 bits. In case the strategy is 'reuse' for a channel in a block, then no exponents are sent for that channel and the decoder reuses the exponents last sent for this channel.

Pre-processing of exponents prior to coding can lead to better audio quality.

Choice of the suitable strategy for exponent coding forms a crucial aspect of AC-3. D15 provides the highest accuracy but is low in compression. On the other hand transmitting only one exponent set for a channel in the frame (in the first audio block of the frame) and attempting to 'reuse' the same exponents for the next five audio block, can lead to high exponent compression but also sometimes very audible distortion.

A.8 Bit Allocation for Mantissas

The bit allocation algorithm analyses the spectral envelope of the audio signal being coded, with respect to masking effects, to determine the number of bits to assign to each transform coefficient mantissa. In the encoder, the bit allocation is recommended to be performed globally on the ensemble of channels as an entity, from a common bit pool.

The bit allocation routine contains a parametric model of the human hearing for estimating a noise level threshold, expressed as a function of frequency, which separates audible from inaudible spectral components. Various parameters of the hearing model can be adjusted by the encoder depending upon the signal characteristic.

The number of bits available for packing mantissas, in an AC-3 frame, is dependent firstly, of course, on the frame-size and, secondly, on the number of bits consumed by other fields—exponents, coupling parameters etc. A significant part of the bit-allocation process is the optimisation of the bit-allocation to mantissa such that under masking consideration, the sum total of all bits consumed by mantissas equals (or is almost close to) available bits. This optimisation may be performed by what is known as a Binary-Convergence Algorithm.

B. Psychoacoustic Model in AC-3

The recent advances in audio coding comes largely due to a deep (although yet incomplete) understanding of the human auditory system. Advantage is taken of the system's inability to hear quantization noise under certain conditions of auditory masking. Thus masking is a perceptual property of the auditory system that occurs whenever a strong audio signal makes imperceptible a weaker signal in its temporal or spectral neighbourhood. A variety of psychoacoustic experiments corroborate this masking phenomenon. Although it is quite complex in nature, gross simplifications of the model are often made for implementation purposes, which surprisingly still produces remarkable results.

B.1 Calculation of PSD—Power Spectral Density

The spectral masking ability of a given signal component depends on its frequency position and loudness, thus the first step towards building the masking levels for a block of audio samples would be to represent the signal on a suitable frequency-amplitude scale. Block of time domain samples x[n] are mapped to frequency domain values, $X_k$, using the 256 band Filter Bank of MDCT.

AC-3 uses the backward adaptive bit allocation philosophy whereby bit allocation information at decoder is created from the coded data itself, without explicit information from encoder (except for some specific parameters: parametric bit allocation). The advantage of this approach is that none of the available bits in the frame are used to define allocation to the decoder.

To allow bit allocation information to be re-created at decoders (independent of the DSP being used) exactly the same as at the encoder (a single mistake can result in mis-interpretation of the whole frame), the bit allocation operations are performed entirely in fixed point arithmetic.

Transform coefficients are mapped to a power spectrum density function using the relation:

$$PSD_k = 128\cdot(24+\log_2\|X_k\|)$$

Since $2^{-24}<\|X_k\|<1$ (constraint of the algorithm), the mapped values are 0 . . . 3072, with higher values representing higher energy. The PSD values are re-computed from at decoder using the transmitted exponents values.

B.2 Grouping into Critical Bands

Empirical results show that the human auditory system has a limited frequency dependent resolution. The receptors of sound pressure in human ear are hair cells. They are located in the inner ear, or more precisely in the cochlea. In the cochlea, a frequency to position transform is performed. The position of the maximum excitation depends on the frequency of the input signal. Each hair-cell at a given position on the cochlea is responsible for an overlapping range on the frequency scale. The perceptual impression of pitch is correlated with a constant distance of hair cells. Depending on the psychoacoustic experiment used, different transform functions from frequency to pitch have been found by various experimenters. Zwicker provides a table which splits the frequency scale in Hz into non-overlapping bands, so called critical bands (sometimes also called Bark Scale).

AC-3 divides the frequency range into 50 bands for masking considerations. A mapping function which approximates the frequency to bark number for AC-3 is given below, the exact value are available in the ATSC standard "*ATSC Digital Audio Compression* (*AC*-3) *Standard*", Doc. A/52/10, November 1994.

$$z/Bark = 12.65\sinh^{-1}\left(\frac{fl\ \mathrm{Hz}}{961}\right)$$

The fine grained PSD values within each critical band are integrated together (with logarithmic addition, since the representation is in exponential domain) to generate a single power value for each band.

Given the critical band scale, masking of steady-state tones and noise inside a critical band is well known. Schroeder *Signal Compression Based on Models of Human Perceptions, Proceedings of the IEEE*, Vol. 81 No. 10, October 1993, in the course of investigating masking phenomenon outside a critical band, introduced the concept of spreading function, which describes for steady state situations, the masking effect of a signal in a critical band on signals in another critical band. This spreading is currently believed to be a by-product of the mechanical cochlea filtering mechanism.

Figure 2:
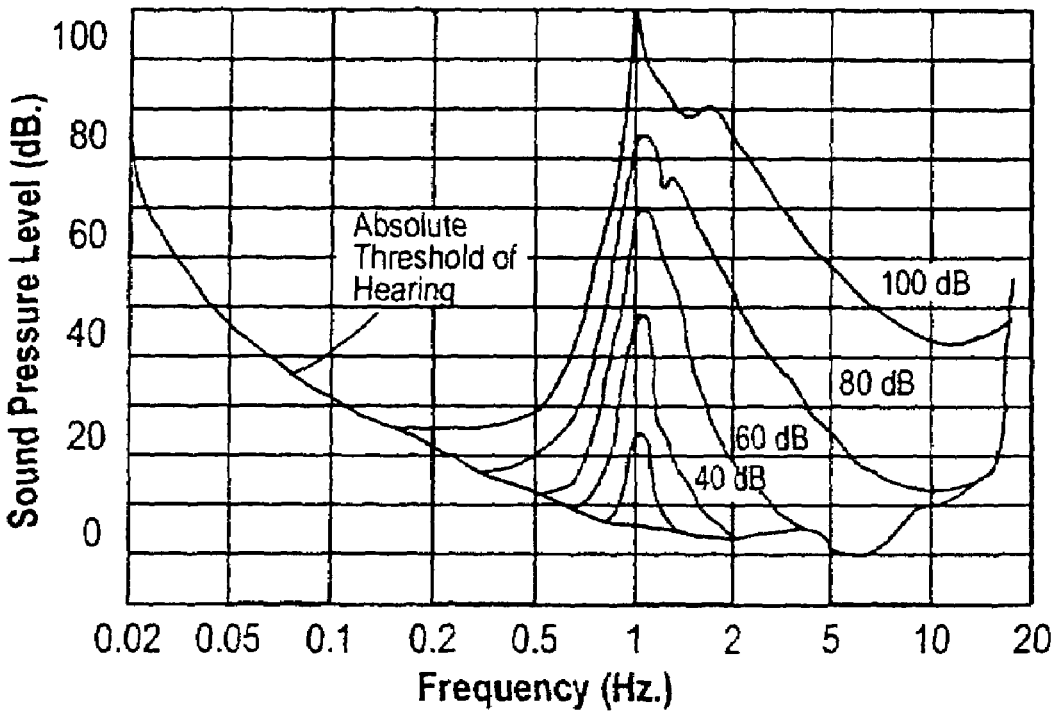
FIG. 2 is a graph representing elevation of an auditory threshold due to a masking at 1 kHz.

The shape of the spreading function varies with level, and the masking abilities of the signal spread farther from the base frequency as the level of the masker is increased. Note in FIG. 2 that the masker does a better job of masking a higher frequency than a lower frequency: a phenomenon called upward spread of masking.

To simplify calculations, AC-3 considers upward masking only. It is to be noted that the masking of noise by the presence of a strong tone, and the masking of a tone due to strong noise are slightly different in nature. The results from masking can sometimes be summarised as Tone masking Noise: $E_N=E_T-7.25-0.5$ B (dB.)

Noise masking Tone: $E_T=E_N-2.25$ (dB.)

where $E_T$ and $E_T$ are tone and noise energies, B is the critical band number. If the masking curve is assumed to be linear, the masking threshold equals the sum of contributions due to all other components of the spectrum. Each contribution is assumed to be similar to the masking pattern of a narrow band signal (the elementary masking). Thus the full masking curve $S_v$ is equal to the convolution on the bark scale v of the power spectral density $Y_v$ by $B_v$ the basiliar membrane spreading function.

B.3 Calculation of Masking Threshold

In AC-3 a simplified technique has been developed to perform the step of convolving the spreading function against the banded PSD. The spreading function is approximated by two lines: a fast decaying upwards masking curve; and a slowly decaying upward masking curve which is offset downward in level (check the close correspondence with the experimental masking curve of FIG. 2). Instead of assuming masking operation to be linear and summing the individual effects, AC-3 selects the masking effect at a point to be the maximum of all the individual contributions.

The masking curve is compared to the hearing threshold (stored in the encoder) and the larger of the two values is retained. Finally the masking curve is subtracted from the original PSD to determine the desired SNR for each individual coefficient. The quantization error for a particular frequency $X_k$ component may be viewed as noise power $Q_k$, which is dependent on the number of bits used for encoding. Ideally the bit allocation should be such that the quantization error is completely masked i.e. $Q_k<S_v$.

In AC-3 the bit allocation for a frequency component is directly related to the masking curve and a variable snroffst, which controls the used bits thereby matching available bits to bits used.

$$S_v=S_v-snroffst$$

$$Bap_k=LUT(PSD_k-\tilde{S}_v)$$

The number of bits to be used for quantization of $X_k$ is found through a Lookup-Table (LUT), using the difference between the $PSD_k$ and the masking value as an index.

C. Perceptual Audio Quality Measurement with AC-3

An important consideration during storage or transmission of coded audio would be to maintain a certain level of quality. While immense savings can be achieved by constricting the bitrate to low values, the quality of compression may become too low as well, especially during periods of high complexity. One can be generous and allocate high bit-rates—this would provide good quality but may result in wastage of channel capacity or storage are, thereby defeating the purpose of a good compression algorithm. To demand the right channel rate or storage area at any time, the encoding scheme must have an perception based objective function to measure audibility of the quantization noise.

An objective function that measures the audibility of the quantization process was introduced by Bradenburg and called the Noise-to-Mask (NMR) ratio. The NMR is based on well documented masking effects, and has been shown to be extremely useful in audio coding and quality assessment. Here we use the not so common Average Weighted NMR, where the weights $w_i$ (on dB. scale) represent listener sensitivity to NMR across frequency range.

$$AWNMR=\frac{1}{N}\sum_{k=1}^{N}\left(\frac{Q_k}{S_v^2}\cdot 10^{\frac{w_i}{20}}\right)$$

Here $Q_k$ is noise power and $S^2_v$, the mask power at the particular frequency. Taking AWNMR on the dB. scale $$AWNMR(\text{db})=20\log_{10}\left[\frac{1}{N}\sum_{k=1}^{N}\left(\frac{Q_k}{s_v^2}\cdot 10^{\frac{w_i}{20}}\right)\right] \quad (1)$$

However, since summation inside a logarithmic term is difficult to evaluate we make a simplification in the above equation. Observing that the individual terms in the above expression are positive real numbers, and the fact that since for positive real numbers arithmetic mean is always greater than geometric mean, we have $$AWNMR(\text{db})\geq 20\log_{10}\left(N\sqrt{\prod_{k=1}^{N}\left(\frac{Q_k}{s_v^2}\cdot 10^{\frac{w_k}{20}}\right)}\right) \quad (2)$$

$$AWNMR(\text{db})\geq\frac{20}{N}\sum_{k=1}^{N}\left(\log_{10}\left(\frac{Q_k}{s_v^2}\right)+\frac{w_k}{20}\right)$$

Taking note that $S_v=128\cdot(24+\log_2 S_v)$ we have $S_v=2^{\frac{S_v}{128}-24}$ The mean square error (noise) power is dependent on the number of bits used for quantization of the coefficient i.e.

$$Q_k\approx\Delta^2/12,\ \text{where}\ \Delta=2/2^{B\sigma p_k}\Rightarrow Q_k\approx\frac{2^{-2B\sigma p_k}}{3}.$$

Therefore $$AWNMR(\text{db})\geq\frac{20}{N}\sum_{k=1}^{N}\left[\log_{10}\left(\frac{2^{-2B_{w_k}}}{3\cdot 2^{2(S_v/128-24)}}\right)+\frac{w_k}{20}\right]$$

However, if we take as noise, the adapted masking curve $\tilde{S}_v^2$, and perform adjustment for the transformation to PSD domain, $$AWNMR(\text{db})\geq\frac{20}{N}\sum_{k=1}^{N}\left[\log_{10}\left(\frac{2^{2(\tilde{S}_v/128-24)}}{3\cdot 2^{2(S_v/128-24)}}\right)+\frac{w_k}{20}\right]=\frac{20}{N}\sum_{k=1}^{N}\left[\log_{10}\left(\frac{2^{(\tilde{S}_v-S_v)/64}}{3}\right)+\frac{w_k}{20}\right]=\theta(snroffst) \quad (3)$$

The expression above is a simplification since it does not differentiate between individual $PSD_k$ values. However, in spite of that it provides a very simple method for attaching quality value for encoded streams.

D. Constant Q VBR Using AWNTMR

The outcome of the derivation in the previous section is that the AWNMR may be assumed as a simple function of the snroffst value. Maintaining snroffst as a constant implies a constant quality of coding, of course, with respect to the objective measuring function AWNMR.

While Equation (1) is most accurate, it is also very computationally expensive. Simplification in (2) renders the frequency dependent weights useless since they all add up to a constant. Equation (3) is even worse but has the advantage of requiring absolutely no additional computation for placing a relative value on the quality of coding.

Experimental results corroborate the fact that AWNMR as the measuring function is useful for maintaining almost constant quality with even while undergoing drastic jumps in bitrate due to varying signal complexity.

Figure 5:
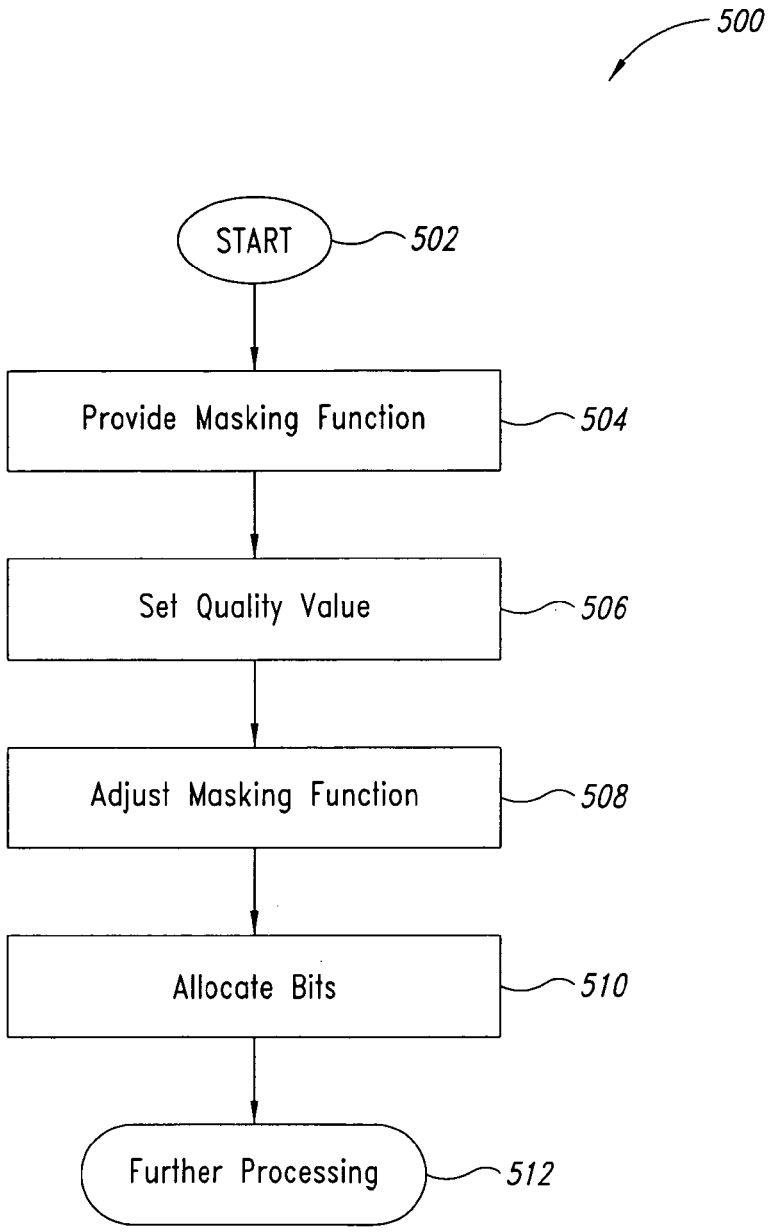
FIG. 5 illustrates a method of encoding an audio signal.

Part of the constant Quality Variable Bit-Rate algorithm is given in the pseudo-code below. The bit allocation is called in the final stage of frame processing in an AC-3 encoder. At this stage the value of bits_used for coding all other information apart from the frequency coefficient mantissas, is known. The masking curve is incremented/decremented depending on the snroffst value. This directly controls the number of bits required for coding mantissas. Under constant bitrate conditions the snroffst values are manipulated to arrive at an allocation which fits into the fixed frame size. Here the snroffst value is fixed and the frame size is manipulated. An appropriate pseudo code for an algorithm of the invention is as follows:

FIG. 5 illustrates a method 500 of encoding an audio signal. At step 502 the method starts. At step 504, a masking function is provided for the audio signal. See the discussion in Section B, above. At step 506, a quality value is set for the audio signal. See the discussion in Sections C and D, above. At step 508, the masking function is adjusted based on the quality value set in step 506. See the discussion in Section D, above. At step 510, bits are allocated for quantization of the encoded audio signal based on the adjusted masking function. At step 512 further processing (i.e., packing, transmission or storage) of the encoded signal may occur.

Figure 6:
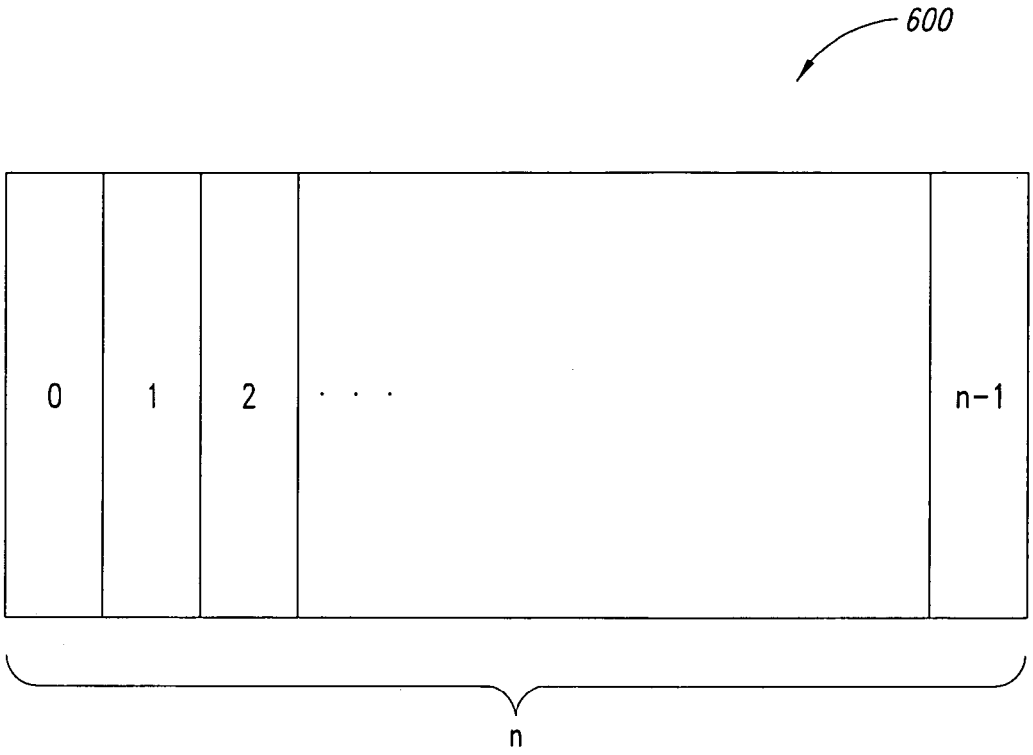
FIG. 6 illustrates a frame length.

FIG. 6 illustrates a data frame 600 of a length n comprising bits 0 through n−1. The length n may be fixed, at, for example, 256×6 (See Section A.1. above) or it may be variable, generally in increments (See Section D, above).

Figure 7:
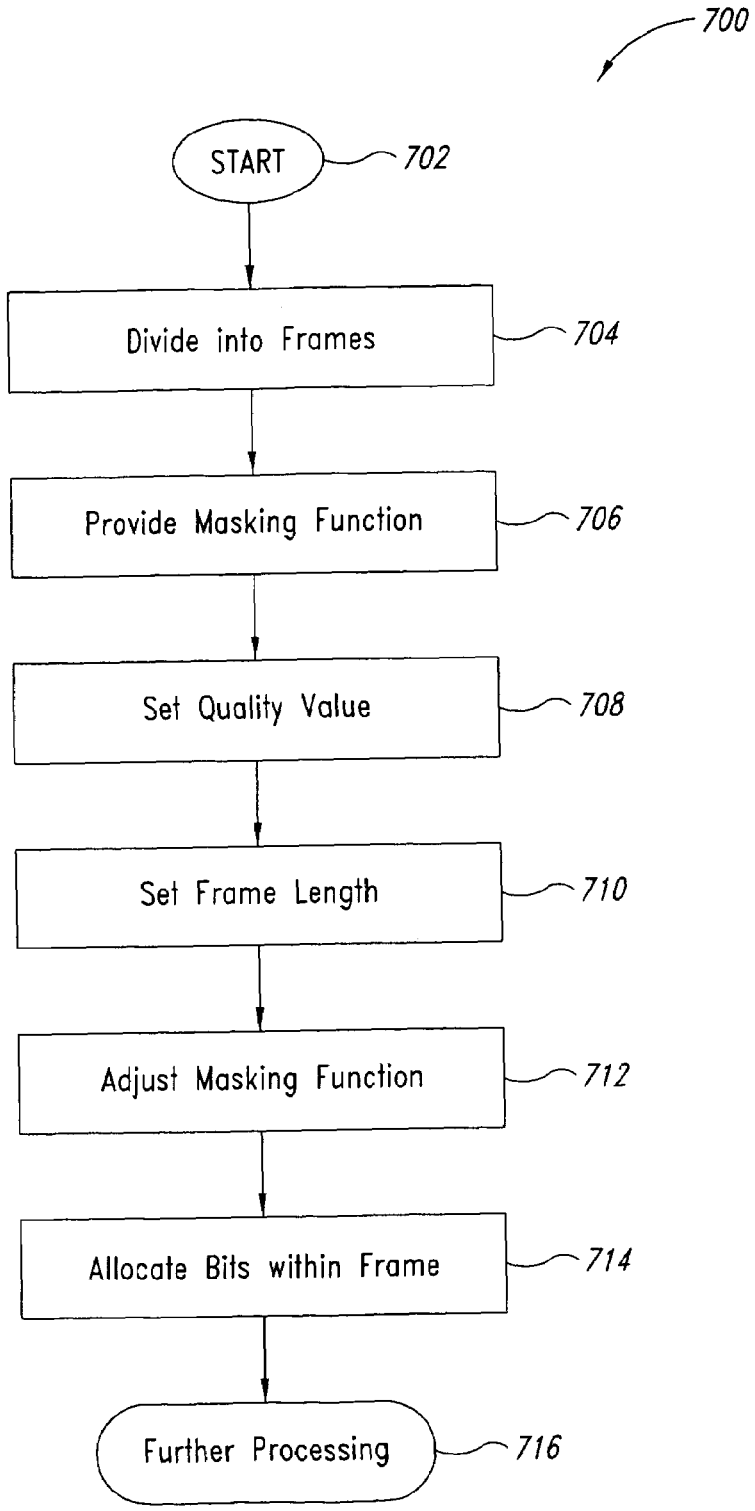
FIG. 7 is another illustration of a method of encoding an audio signal.

FIG. 7 illustrates a method 700 of encoding an audio signal. At step 702 the method starts. At step 704, the input signal is divided into one or more frames. See Section A, above. At step 706, a masking function is provided for the audio signal. See the discussion in Section B, above. At step 708, a quality value is set for the audio signal. See the discussion in Sections C and D, above. At step 710, a frame length corresponding to the quality value is determined for each frame. See the discussion in Section D, above. At step 712, the masking function for each frame is adjusted based on the frame length. See the discussion in Section D, above. At step 714, bits are allocated within each frame for quantization of the encoded audio signal dependent on the adjusted masking function. At step 716, further processing (i.e., packing, transmission or storage) of the encoded signal may occur.

Experiments were performed for two channel AC-3 Encoder. The AWNMR was fixed at a certain level such that average bitrate is about 192 kbps (i.e. overall quality coding noise is almost imperceptible). A Noise-Mask-Ratio for castanets was then obtained, as shown in FIG. 3 and the bit rate requirements calculated, as represented in FIG. 4.

During simple sequences (silence or simple tones) a low bit-rate ~64 kpbs is sufficient to attain the required AWNMR. For complex music the bitrate (consequently frame size) needs to be increased to ~256 kbps to maintain the same pre-defined AWNMR. The advantage is that instead of varying the quality, the bit-rate is made variable and quality is almost constant. The average bitrate for different NMR/snroffst can be empirically calculated by simulations with an assortment of music test vectors. In addition to that hard thresholds can be placed for maximum frame size to prevent excessive bitrate demands.

The invention claimed is:

1. A method for encoding an input audio signal to produce an encoded audio signal, comprising;

providing a masking function, representative of psychoacoustic masking;

setting a quality value for data of the encoded audio signal, adjusting the masking function dependent upon the quality value; and allocating bits for quantization of the encoded audio signal based on the adjusted masking function.

2. A method as claimed in claim 1, wherein the quality value represents an average weighted noise-to-mask ratio (AWNMR).

3. A method as claimed in claim 2, wherein the quality value is equated to a variable θ, such that $$AWNMR(\text{dB}) \geq \frac{20}{N}\sum_{k=1}^{N}\left[\log_{10}\left(\frac{2^{2(\tilde{S}_v/128-24)}}{3\cdot 2^{2(S_v/128-24)}}\right)+\frac{w_k}{20}\right]=$$

$$\frac{20}{N}\sum_{k=1}^{N}\left[\log_{10}\left(\frac{2^{(\tilde{S}_v-S_v)/64}}{3}\right)+\frac{w_k}{20}\right]=\theta(snroffst)$$

where $S_v$ is the masking function, $\tilde{S}_v$ is the adjusted masking function, $W_k$ is a weighted function, and snroffst is a variable proportion to the signal to mask ratio.

4. A method as claimed in claim 3, further comprising:

deriving transformation coefficients from input audio signal for encoding; and mapping the transform coefficients to a power spectrum density function (PSD), wherein the bit allocation is determined by differencing the PSD and the adjusted masking function.

5. A method as claimed in claim 3, further comprising:

dividing the input audio signal into a plurality of frames, for carrying quantization bits and signal data; and increasing or decreasing a frame length of one of the frames until the frame accommodates the quantization bits.

6. A method as claimed in claim 1, wherein transform coefficients are derived from the input audio signal for encoding and are mapped to a power spectrum density function (PSD) and wherein the bit allocation is determined by differencing the PSD and the adjusted masking function.

7. A method as claimed in claim 6, further comprising:

dividing the input audio signal into a plurality of frames, for carrying quantization bits and other signal data; and increasing or decreasing a frame length of one of the frames until the frame accommodates the quantization bits.

8. A method as claimed in claim 1, wherein encoding the input audio signal includes dividing the signal into a plurality of frames, for carrying quantizsation and other signal data, and increasing or decreasing one or more frame lengths until the associated frame accommodates the bits allocated for quantization.

9. A method as claimed in claim 1, wherein the adjusting of the masking function is dependent upon the quality value and the input audio signal.

10. A method as claimed in claim 1, wherein the encoded audio signal comprises an AC-3 signal.

11. A method as claimed in claim 1, wherein the encoded audio signal is compressed at a compression ratio, wherein the compression ratio is variable, and the compression ratio is determined by the quality value and the input audio signal.

12. A method as claimed in claim 11, wherein the input audio signal has a complexity in a frequency domain, and the compression ratio is dependent upon the complexity of the input audio signal.

13. A method for encoding an input audio signal to produce a constant quality encoded audio signal, comprising;

dividing the input audio signal into one or more frames;

providing a masking function, representative of psychoacoustic masking;

providing a quality value for data of the encoded audio signal, wherein the quality value is held constant;

determining a frame length required to encode each frame at the quality value;

adjusting the masking function dependent upon the frame length of each frame; and allocating bits within each frame for quantization of the encoded audio signal dependent upon the adjusted masking function.

14. A method as claimed in claim 13, wherein the frame length is dependent upon the quality value and the input audio signal.

15. A method as claimed in claim 13, wherein the encoded audio signal is compressed at a compression ratio, wherein the compression ratio is variable, and the compression ratio is determined by the quality value and the input audio signal.

16. A method as claimed in claim 15, wherein the input audio signal has a complexity in a frequency domain, and the compression ratio is dependent upon the complexity of the input audio signal.

17. A method as claimed in claim 16, wherein the quality value represents an average weighted noise-to-mask ratio (AWNMR).

18. A method as claimed in claim 16, wherein the quality value is equated to a variable θ, such that $$AWNMR(\mathrm{dB}) \geq \frac{20}{N}\sum_{k=1}^{N}\left[\log_{10}\left(\frac{2^{2(\tilde{S}_v/128-24)}}{3\cdot 2^{2(S_v/128-24)}}\right)+\frac{w_k}{20}\right]=$$

$$\frac{20}{N}\sum_{k=1}^{N}\left[\log_{10}\left(\frac{2^{(\tilde{S}_v-S_v)/64}}{3}\right)+\frac{w_k}{20}\right]=\theta(snroffst)$$

where $S_v$ is the masking function, $\tilde{S}_v$ is the adjusted masking function, $W_k$ is a weighted function, and snroffst is a variable proportion to the signal to mask ratio.

19. A method as claimed in claim 16, wherein the encoded audio signal comprises an AC-3 signal.

20. A method as claimed in claim 19, wherein the quality value represents an approximation of the average weighted noise-to-mask ratio (AWNMR).

* * * * *